US007134302B2

(12) United States Patent
Gorst

(10) Patent No.: US 7,134,302 B2
(45) Date of Patent: Nov. 14, 2006

(54) SECURITY DEVICE

(75) Inventor: Alan Jeffrey Gorst, Saddleworth (GB)

(73) Assignee: Sports-Tag Limited, Warrington (GB)

( * ) Notice: Subject to any disclaimer, the term of this patent is extended or adjusted under 35 U.S.C. 154(b) by 0 days.

(21) Appl. No.: 10/478,911

(22) PCT Filed: Apr. 28, 2003

(86) PCT No.: PCT/GB03/01809

§ 371 (c)(1),
(2), (4) Date: Apr. 30, 2004

(87) PCT Pub. No.: WO03/093614

PCT Pub. Date: Nov. 13, 2003

(65) Prior Publication Data

US 2004/0172988 A1 Sep. 9, 2004

(30) Foreign Application Priority Data

Apr. 30, 2002 (GB) ..... 0209915.8
Jul. 16, 2002 (GB) ..... 0216507.4
Dec. 21, 2002 (GB) ..... 0229735.6

(51) Int. Cl.
*E05B 65/00* (2006.01)

(52) U.S. Cl. ..... 70/57.1; 70/14; 70/19; 70/441; 340/572.9

(58) Field of Classification Search ..... 70/14–19, 70/57.1, 59, 441, DIG. 49; 340/572.9
See application file for complete search history.

(56) References Cited

U.S. PATENT DOCUMENTS 2,738,113 A * 3/1956 Sigler ..... 294/165
4,094,504 A * 6/1978 Barasch ..... 473/461
4,649,397 A * 3/1987 Heaton et al. ..... 343/895
5,493,274 A * 2/1996 Long ..... 340/568.6
5,508,682 A * 4/1996 Wachsman ..... 340/568.4
5,806,350 A * 9/1998 Savinsky ..... 70/18
5,864,290 A * 1/1999 Toyomi et al. ..... 340/572.9
5,883,576 A * 3/1999 De La Huerga ..... 340/573.1
5,952,921 A * 9/1999 Donnelly ..... 340/568.6
5,969,613 A * 10/1999 Yeager et al. ..... 340/572.9
6,052,876 A * 4/2000 Hogan et al. ..... 24/704.1
6,057,762 A * 5/2000 Dusza ..... 340/568.6
6,098,256 A * 8/2000 Poussard ..... 24/704.1
6,311,531 B1 * 11/2001 Sykes ..... 70/57.1
6,326,890 B1 * 12/2001 Costa ..... 340/572.9
6,374,647 B1 * 4/2002 Holmgren ..... 70/57.1
6,434,982 B1 * 8/2002 Rowland ..... 70/211
6,589,067 B1 * 7/2003 Kolton et al. ..... 439/491
6,598,433 B1 * 7/2003 Malvasio ..... 70/18
6,599,201 B1 * 7/2003 Grant ..... 473/256

(Continued)

FOREIGN PATENT DOCUMENTS

EP 1074682 * 2/2001

(Continued)

*Primary Examiner*—Suzanne Dino Barrett
(74) *Attorney, Agent, or Firm*—Egbert Law Offices

(57) ABSTRACT

A security device includes a carrier for a tell-tale provision having electro-magnetic characteristics. The device is adapted to be releasably secured to an article to be protected, in particular to the shaft of a golf club, in a tamper-resilient manner and to retain the tell-tale provision in a spaced relationship from the article. In this way any adverse magnetic effects on the tell-tale provision by ferromagnetic parts of the article are avoided. Preferably, the tell-tale provision is spaced at least 3 mm from the article to which the device is secured.

14 Claims, 8 Drawing Sheets

U.S. PATENT DOCUMENTS 6,601,414 B1 * 8/2003 Chang ..... 70/57.1
6,640,657 B1 * 11/2003 Smith et al. ..... 73/866.5
6,739,981 B1 * 5/2004 Lin ..... 473/219
D506,694 S * 6/2005 Corney ..... D10/104
D508,657 S * 8/2005 Belden, Jr. ..... D10/104
7,004,848 B1 * 2/2006 Konow ..... 473/223
2003/0008722 A1 * 1/2003 Konow ..... 473/223
2005/0062608 A1 * 3/2005 Costa ..... 340/572.9
2006/0021394 A1 * 2/2006 Belden ..... 70/57.1

FOREIGN PATENT DOCUMENTS

FR 2704592 * 11/1994

* cited by examiner

SECURITY DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a security device such as may be used to tag articles to provide a protection against theft where such articles are on display for handling by prospective purchasers.

BACKGROUND OF THE INVENTION

The invention arises from a particular consideration of anti-theft security for golf clubs. Hitherto, known security devices of tell-tale tag type requiring removal were not effective for golf clubs where comfortable trial swings are seen as essential for most golfers considering purchase.

Accordingly, this invention is predicated on the concept of providing a device capable of snug-fitting to an article so as to be unobstructive to handling as desired, such device resisting all but authorized removal.

BRIEF SUMMARY OF THE INVENTION

According to the present invention there is provided a security device comprising a carrier for a tell-tale provision having electromagnetic characteristics, the device being capable of being releasably secured to an article to be protected in a tamper-resilient manner, and characterized in that the carrier is adapted to retain the tell-tale provision in a spaced relationship from the article such that any adverse magnetic effects on the tell-tale provision by ferromagnetic parts of the article are avoided.

Preferably, the tell-tale provision is spaced at least 3 mm from an article to which the device is secured.

Preferably also, the carrier retains the tell-tale provision in a position such that it is also spaced from any adverse magnetic effects arising from proximity to another article external to the device.

Shielding is preferably also provided to further protect the tell-tale provision from any adverse magnetic effects by ferromagnetic parts of the article.

Advantageously, the device comprises two inter-engaging body parts that can be releasably secured to one another around the or part of the article, preferably by being hinged together to close around and clasp a part of the article to be protected.

Preferably also, each of the body parts defines a half-cylindrical sleeve that together define a cylindrical sleeve that fits about a cylindrical portion of the article when the body parts are secured together.

Preferably also, the half-sleeves are provided with cushioning compliance in order that the device can be snug-fitted to articles in a range of sizes.

It is also an advantage if the interior edge parts of the half-cylindrical sleeves define recesses that create weak or break points so that the edge parts will break off before the body parts can be pried open by levering down the cylindrical sleeve.

Preferably also, the inter-engaging body parts can only be released by means of a tool or a key.

Preferably also, the inter-engaging body parts resiliently engage with one another in a snap-fit manner.

Preferably also, each body part comprises at least two integral projections shaped such that they resiliently inter-engage respectively with complimentary projections provided on the other body part.

Preferably also, each of the projections of one body part defines an outwardly extending tooth that snap-fits around a similar tooth defined by its complimentary projection of the other body part. Three sets of snap-fitting teeth are preferably provided in an orthogonal arrangement.

Preferably also, each of the projections of one body part is provided with a projecting rib that can itself be engaged by a prong of an opening tool that can be inserted through a hole provided in a face of the other body part.

Preferably also, the prong acts on the projecting rib to cause a resilient deflection of the projection sufficient to enable the tooth defined by the projection to be disengaged from the tooth of the complimentary projection of the other body part.

Preferably also, the edges of the body parts 21 and 22 are provided with rib and groove formations 38 and 39 respectively in complementary matching relation to inter-engage on closure of the body parts 21 and 22.

Advantageously, the rib and groove formations define a labyrinthine pathway therebetween. Such an arrangement frustrates attempts to lever the two body parts apart.

As applicable to golf clubs, a device in accordance with the present invention may fit snugly about a golf club shaft at a localized position between its head and grip, preferably with a locating action that is tolerant of a range of shaft diameters, say with compliant gripping.

BRIEF DESCRIPTION OF THE SEVERAL VIEWS OF THE DRAWINGS

The present invention will now be described by way of example with reference to the accompanying drawings.

DETAILED DESCRIPTION OF THE INVENTION

Figure 1:
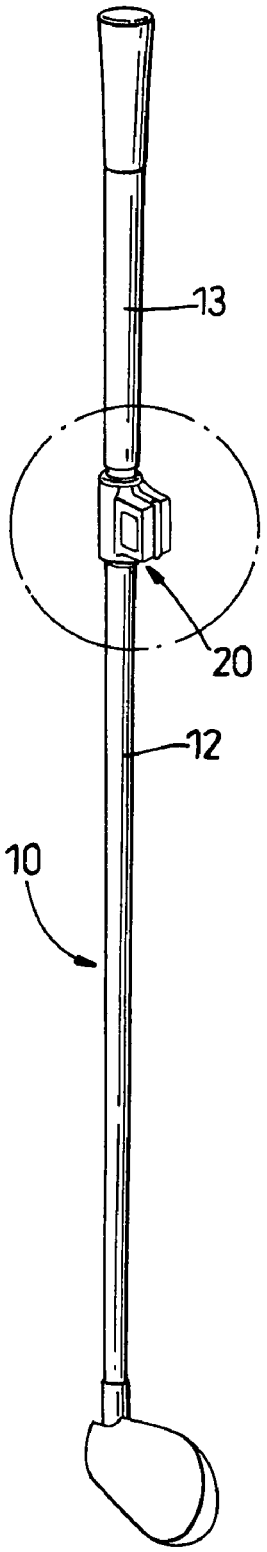
FIGS. 1 and 1*a* are perspective and detail views of a golf club fitted with a first embodiment of security device in accordance with the invention.
Figure 1A:
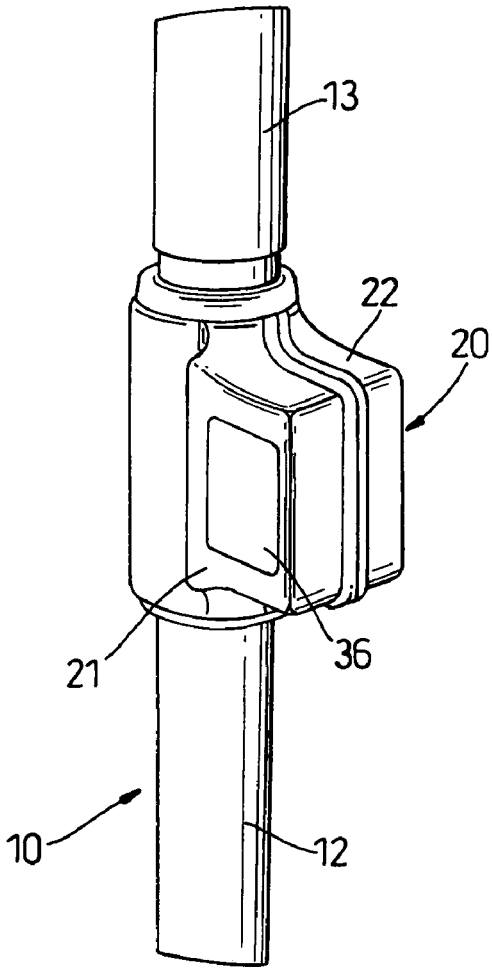
Figure 9:
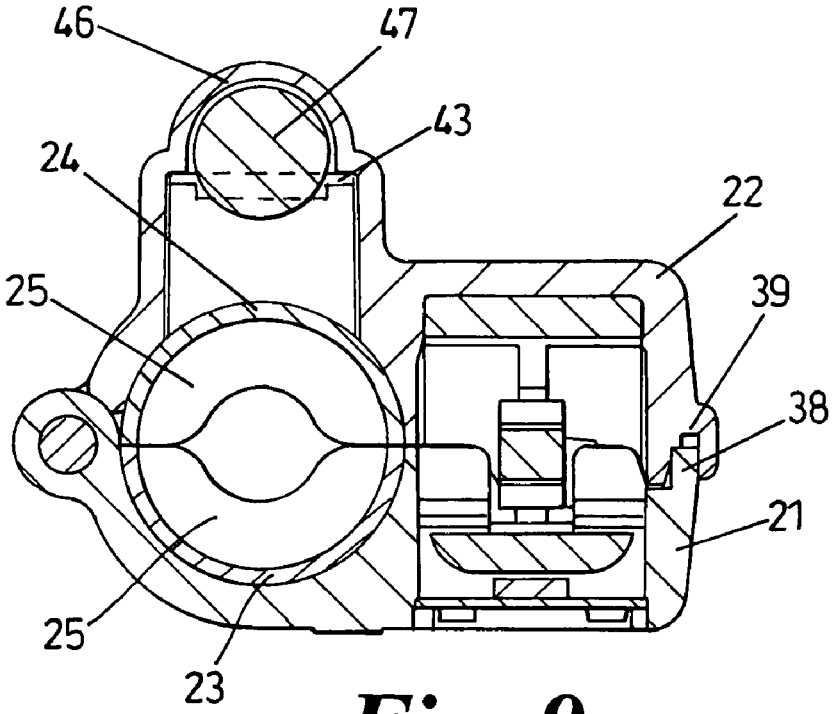
FIGS. 9 and 10 are transverse cross-sectional views along the lines IX—IX and X—X in FIG. 4.
Figure 10:
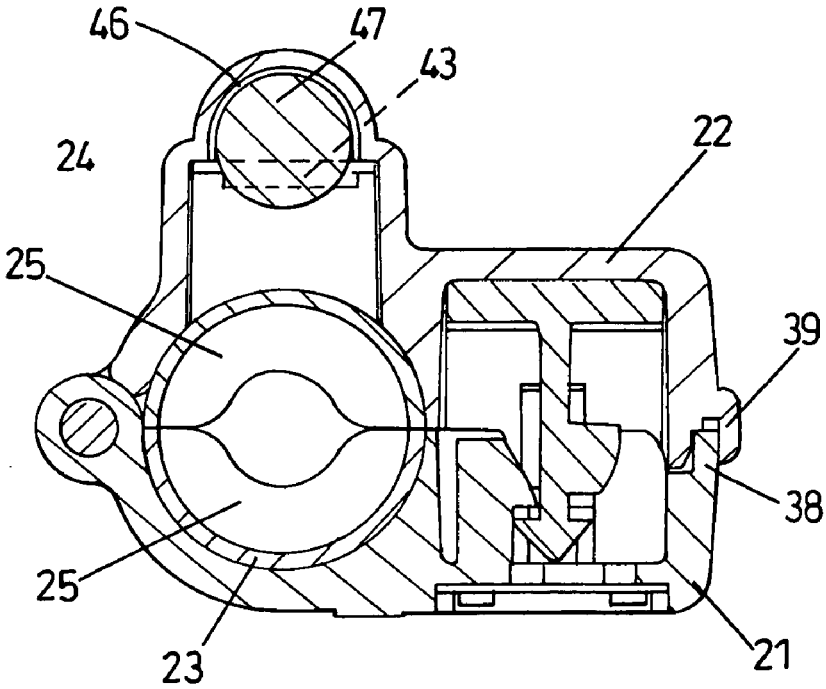

As shown in FIG. 1, a security device 20 according to the invention is particularly adapted for fitment at a localized position of a shaft 12 of a golf club 10, just below a grip 13 at the top of the shaft 12. The device 20 has two body parts 21, 22 respectively defining resilient half-cylindrical sleeves 23, 24 that form an cylindrical sleeve that fits snugly about the shaft 12, preferably with compliant gripping, such as cushioning. The cushioning can be provided by rubber or foam cushions 25 that fit into recesses defined in the sleeves 23, 24, as shown in FIGS. 9 and 10. However, the cushions 25 have been omitted from the other figures for the sake of clarity. Preferably, the body parts 21 and 22 are each integrally formed by moulding from a suitable resilient material, for example polypropylene, nylon, and acetyl plastics materials.

In the illustrated embodiment, the body parts 21, 22 are hinged together by a hinge pin 26 that passes through intercalating hinge-lug formations 27. It should be appreciated, that the hinge between the parts 21 and 33 may be formed in many other ways, for example the two parts can be integrally formed in an integrated clam-shell moulding with a integral hinge formation formed by a thinning of the constituent material as suited to such moulding. It is important, however, that regardless of the particular form of construction that the hinge is resistant to tampering and cannot be easily broken apart.

Figure 2:
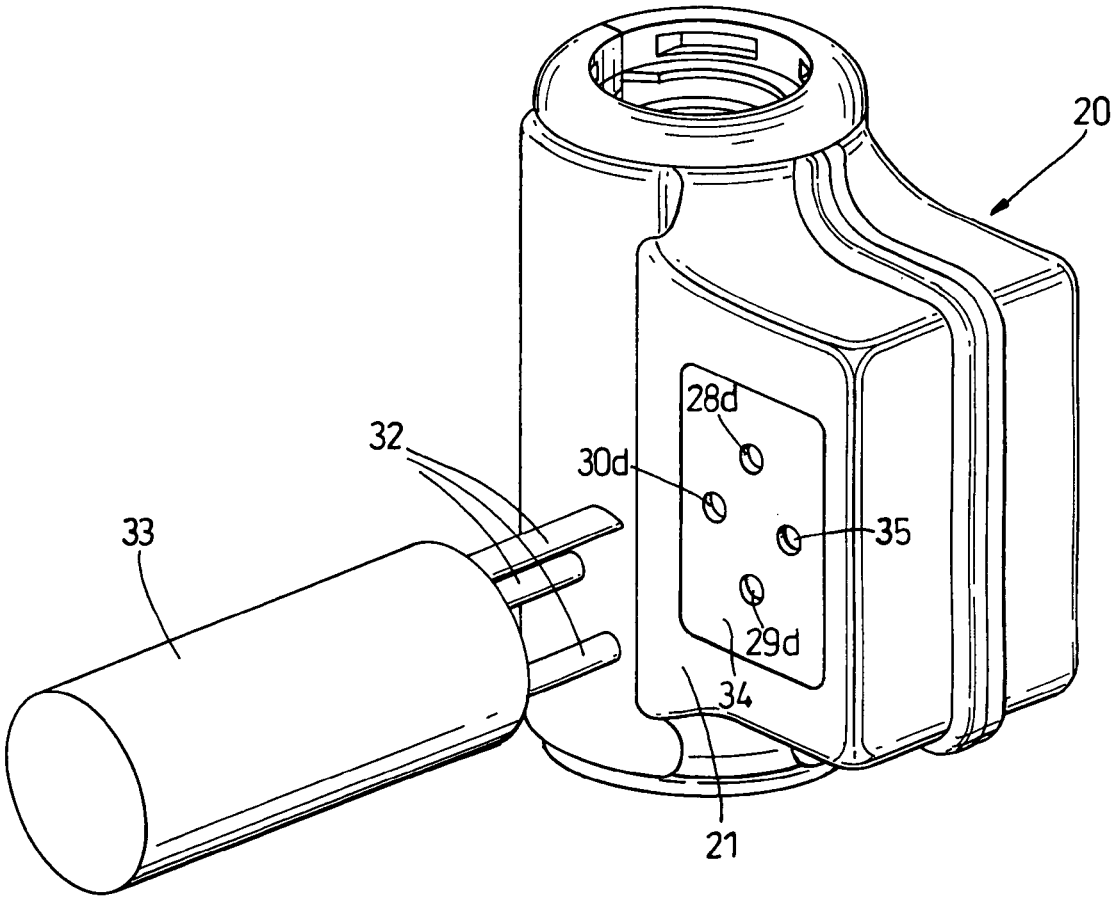
FIG. 2 is a perspective view, to an enlarged scale, of the security device when closed and with a cover plate removed in proximity to a tool for use in opening the device.
Figure 3:
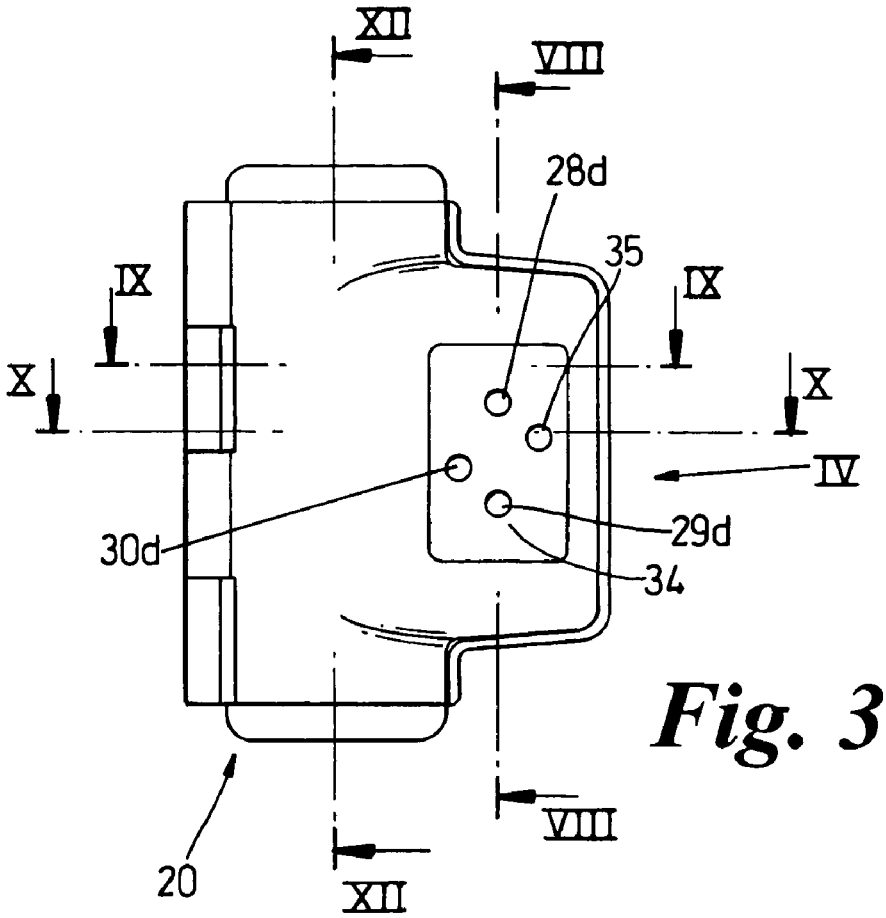
FIG. 3 is a side view of the device shown in FIG. 2.
Figure 4:
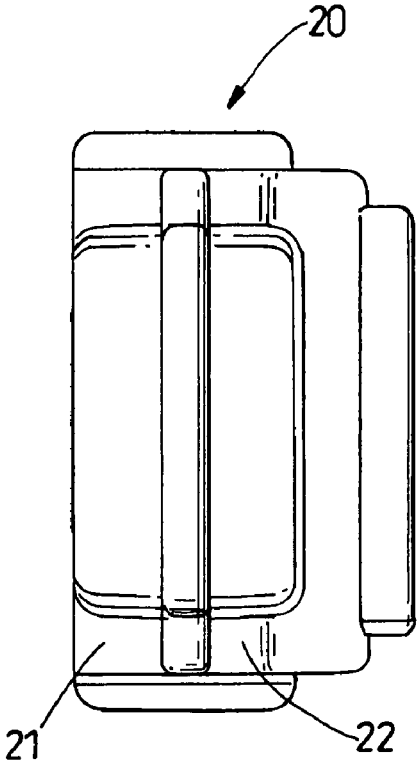
FIG. 4 is an front view of the device shown in FIG. 3 in the direction of arrow IV.
Figure 5:
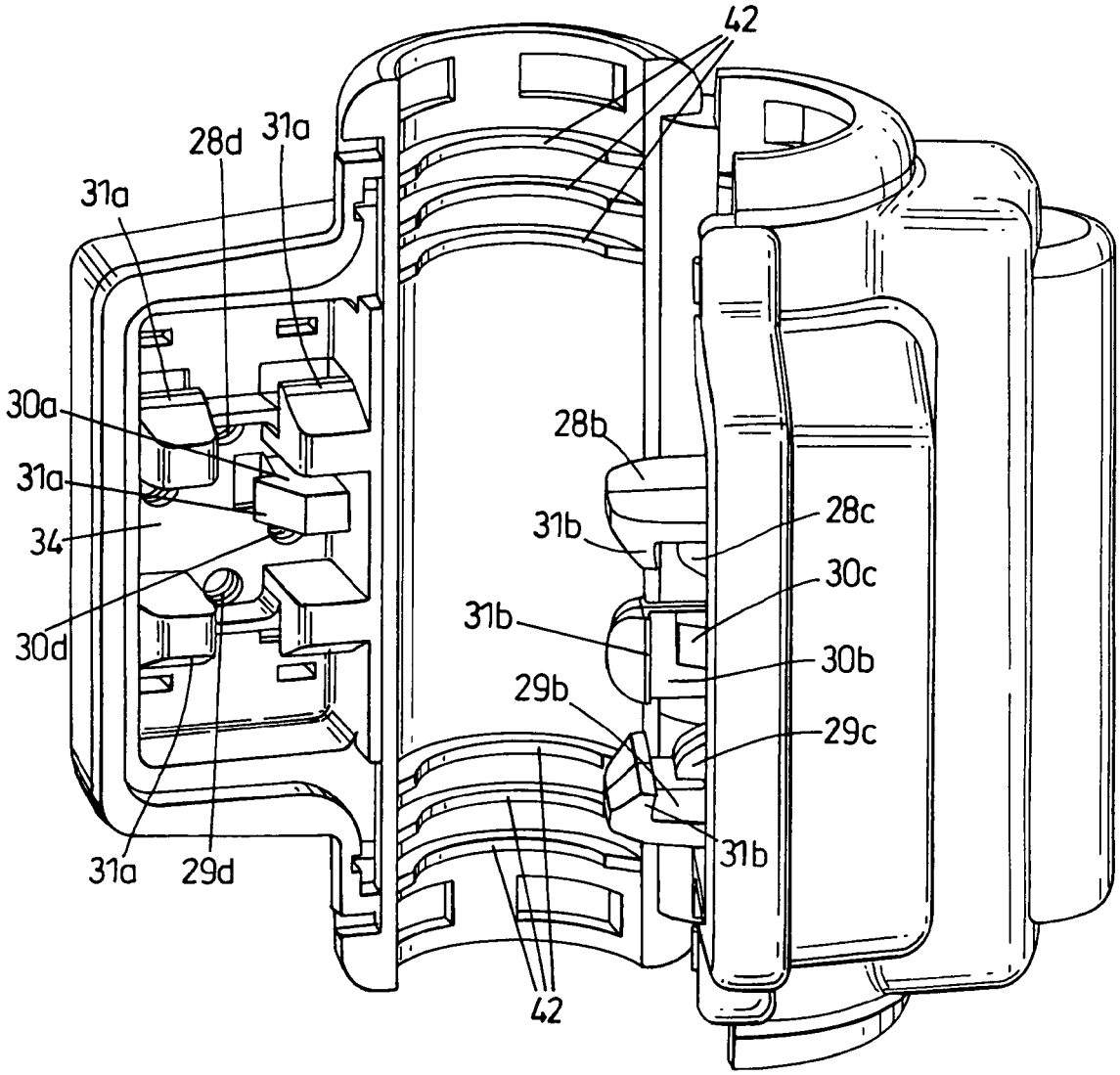
FIGS. 5 and 6 are perspective views from slightly different direction of the device when opened to reveal interior detail thereof.
Figure 6:
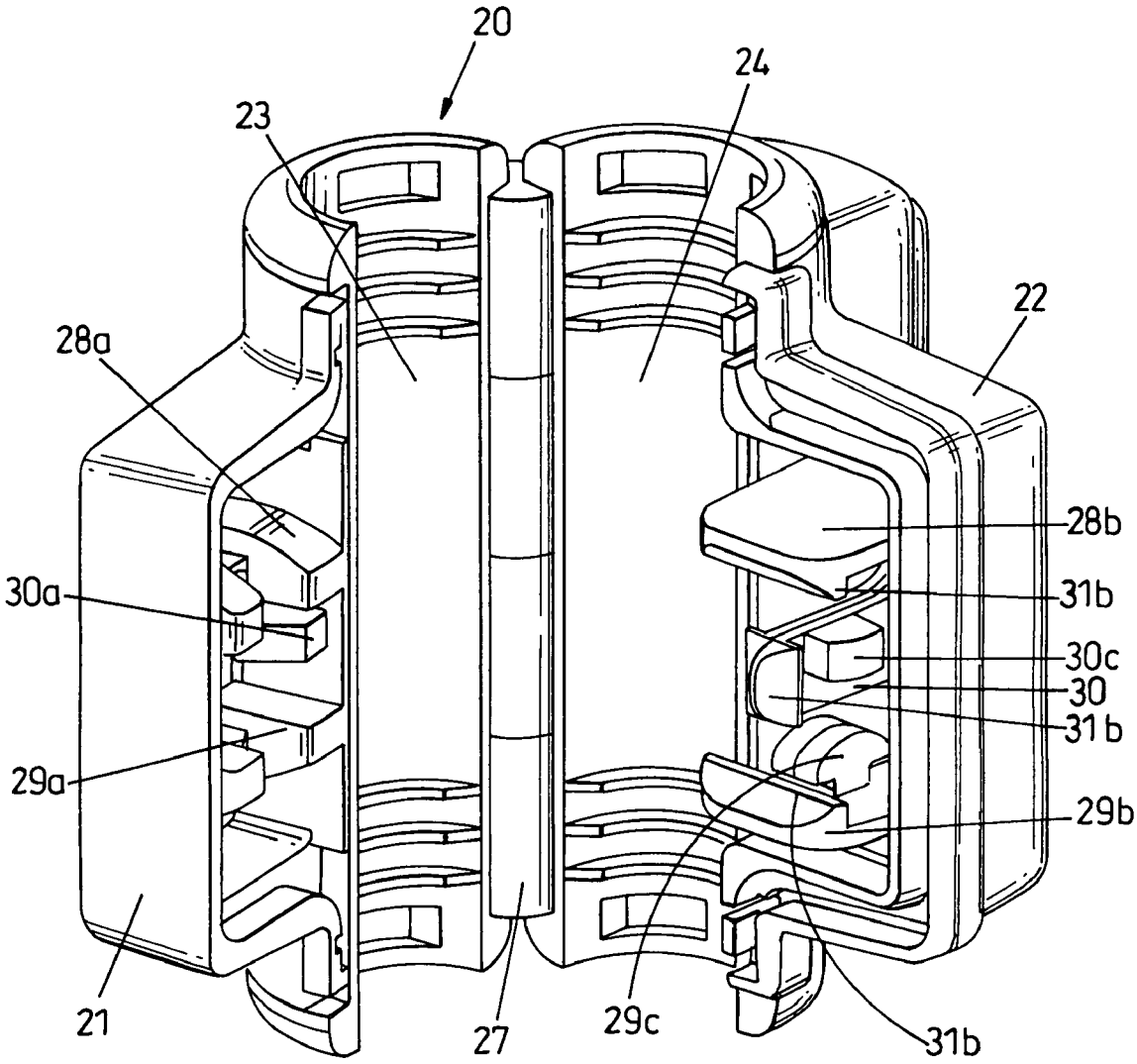
Figure 7:
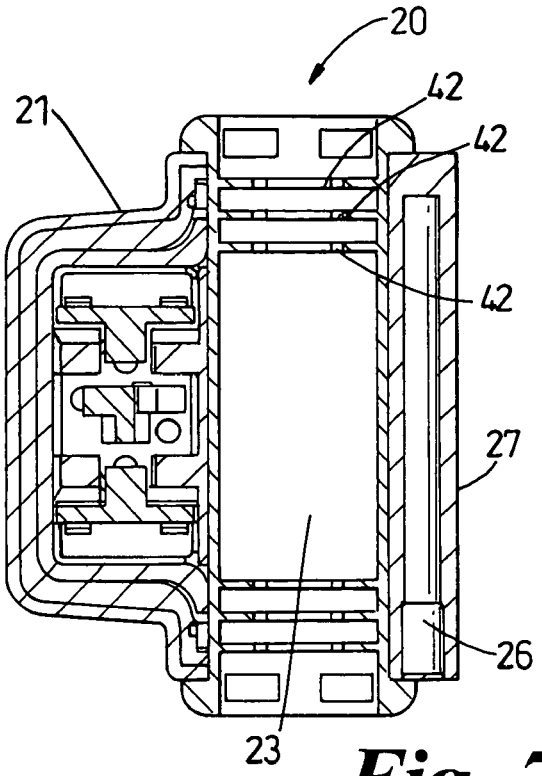
FIG. 7 is a cross-sectional view along the line VII—VII in FIG. 4.
Figure 8:
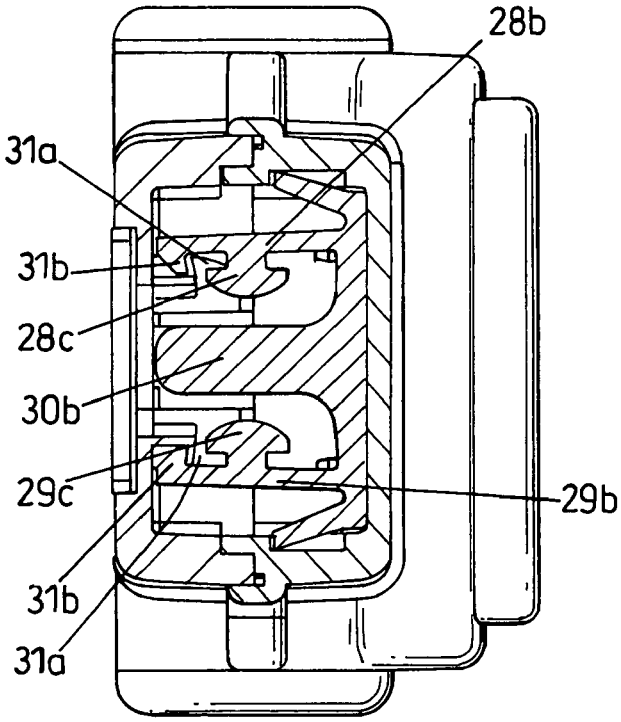
FIG. 8 is a cross-sectional view along the line VIII—VIII in FIG. 3.

In a box portion adjoining the sleeve 24, the body part 21 is provided with three integral internal toothed projections 28*a*, 29*a*, 30*a* that resiliently inter-engage respectively with complimentary integral internal toothed projections 28*b*, 29*b*, 30*b* provided on the other body part 22. Preferably, the pairs of inter-engaging projections are arranged such that they inter-engage orthogonally. In the present example, each of the projections 28*a* 29*a* and 30*a* has outwardly extending teeth 31*a* that snap-fit around teeth 31*b* provided on the projections 28*b*, 29*b*, 30*b* of the part 22 when the parts 21 and 22 are pressed together. In addition, each of the projections 28*b*, 29*b*, 30*b* is provided with a projecting mushroom-section rib 28*c*, 29*c*, 30*c* respectively. When the teeth 31*a* and 31*b* are inter-engaged, the ribs 28*c* and 29*c* locate between recesses formed respectively in the projections 28*a* and 29*a*. The ribs 28*c*, 29*c*, and 30*c* project outwardly from the inter-engaged projections and can themselves be engaged by one of three prongs 32 provided on a special opening tool 33 (see FIG. 2) that are spaced so that they can be inserted through respectively through holes 28*d*, 29*d*, and 30*d* provided in an extension side face 34 of the body part 21. The prongs 32 act on the convex heads of the mushroom-shaped ribs 28*c*, 29*c*, and 30*c* 28*c* and resiliently deflect the projections 28*b*, 29*b*, 30*b* sufficiently to enable the teeth 31*a* and 31*b* to be disengaged from one another in order that the body parts 21 and 22 can be hinged open.

It will be appreciated that this arrangement of resiliently inter-engaging parts which lock the body parts 21 and 22 together is simply one of many arrangements which could be adopted. However, it is important that any arrangement adopted can only be disengaged using a specially designed tool or key to prevent readily available tools such as screwdrivers and the like being used illegally to remove the device 20 from the article 10. Similarly, it is advantageous that at least two, and preferably three orthogonally arranged, sets of inter-engaging formations are provided in order to make their disengagement difficult and thereby to deter tampering.

Another hole or holes 35 in the same side face 34 serve in securing a cover plate 36 by an interference fitting integral peg or pegs (not shown). This serves to hide the entry points for the tool or key as an additional deterrence against tampering.

The edges of the body parts 21 and 22 are provided with rib and groove formations 38 and 39 respectively in complementary matching relation to inter-engage on closure of the body parts 21 and 22. As shown in FIGS. 9 and 10, the overlapping mouldings forming the rib and groove formations 38, 39 define a labyrinthine pathway therebetween that deflects any probing tools that may be used in an attempt to prise the parts 21 and 22 apart.

Figure 11:
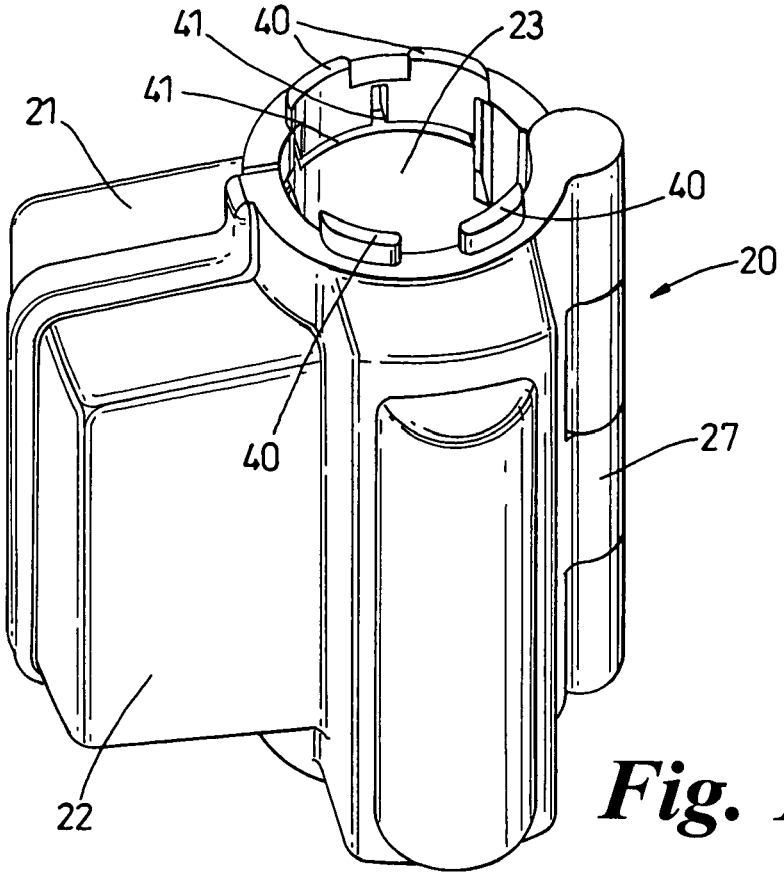
FIG. 11 is a perspective view of a modified security device in accordance with the invention, shown in a closed position.

In a modified embodiment, as shown in FIG. 11, the edges of the sleeves 23, 24 are provided with castellations 40 and recesses 41 that create weak or break points. This means that if a tool such as a screwdriver or similar is pushed down the cylindrical sleeve defined by the sleeves 23, 24 when the device is attached to a golf club in an attempt to lever the parts 21 and 22 apart, the castellations 40 and edge parts of the sleeves 23 and 24 will break off before the parts 21 and 22 can be pried open.

The sleeves 23 and 24 are provided with locating engagement with compliant gripping to a range of shaft diameters by way of deformable internal ribs 42 located in spaced relation towards each end of each sleeve 23 and 24. These may be provided in addition to the cushions 25. Alternatively, both the ribs 42 and the cushions 25 could be replaced by pre-formed rubber mouldings (not shown) or by self-adhesive foam pads (not shown) fixed within the sleeves 23, 24.

Figure 12:
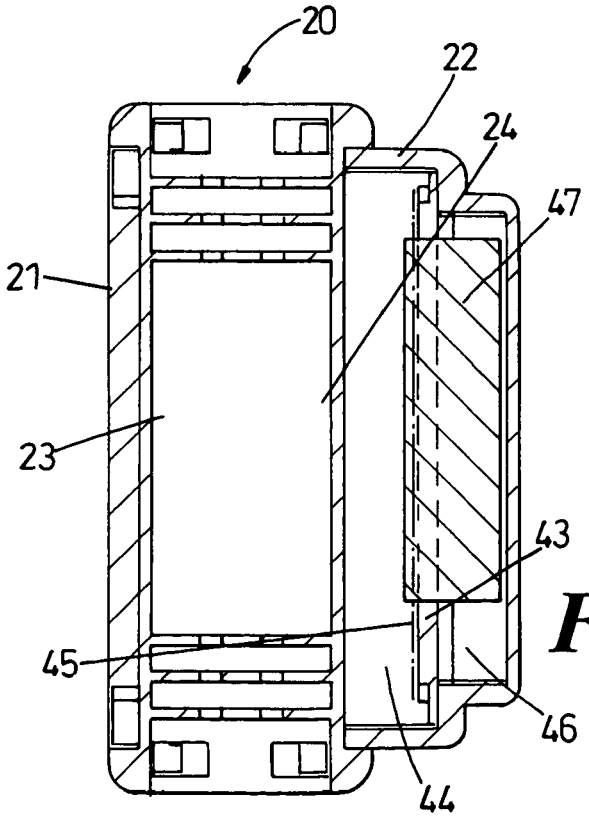
FIG. 12 is a cross-sectional view along the line XII—XII in FIG. 3.

As shown particularly in FIG. 12, a tell-tale provision is provided by means of a planar member 43 having electromagnetic characteristics that can be sensed at exit from premises if the device 20 has not been removed from the article to which it has been attached. The member 43 is located internally of the device 20 in a chamber 44 provided in the body part 22. The chamber 44 is provided with grooves or other means for the location of the member 43 in a spaced relationship from the article, typically a golf club shaft 12 that passes through the cylinder defined by the half-sleeves 23,24. Preferably, the size of the chamber 44 and the position of the member 43 is such that the latter can be located at least 3 mm and preferably at least 5 mm away from the article in order that any adverse magnetic effects on the tell-tale provision by ferromagnetic parts of the article, such as the shaft 12 itself, are avoided. In addition, a shielding material 45 covering one side of the member 43 may also be interposed between the part of article, i.e. the shaft 12, passing through the sleeves 23 and 24 and the tell-tale provision 43 in order to block adverse magnetic effects from the shaft 12. It will also be appreciated that the provision 43 is located within the chamber 44 such that it is also spaced from any ferromagnetic articles exterior to the device 20 that could be pressed against the device with a view to fooling a sensor for detecting the presence of the device 20.

The chamber 44 may also define an additional semi-cylindrical void 46 at one side which can be used to accommodate other conventional devices or tags 47, such as an RF device or similar.

I claim:

1. An anti-theft security device for a golf club comprising:

a golf club having a shaft, said shaft having a ferromagnetic portion;

a carrier having a pair of inter-engaging body parts hinged together so as to close around and clasp a part of said ferromagnetic portion of said shaft, each of said pair of inter-engaging body parts being a shell formed of a resilient material, said pair of inter-engaging body parts being releasably secured together so as to form a cylindrical sleeve that snugly fits entirely around and grips said shaft of said golf club, each of said pair of inter-engaging body parts being a half-cylindrical sleeve, said carrier defining a chamber having a tell-tale provision therein, said tell-tale provision having electromagnetic characteristics, said tell-tale provisions being enclosed within said carrier and retained within said chamber when said carrier is clasped to said shaft in spaced relation to said part of said ferromagnetic portion of said golf club so as to avoid any adverse magnetic effects from said ferromagnetic portion of said golf club upon said tell-tale provision, said tell-tale provision being spaced at least 3 millimeters from said shaft.

2. The device of claim 1, said carrier spacing said tell-tale provision from adverse magnetic effects from items exterior of said carrier and said golf club.

3. The device of claim 1, said carrier further comprising a shielding positioned adjacent said tell-tale provision.

4. The device of claim 1, said half-cylindrical sleeve having a compliant gripping therein.

5. The device of claim 1, said half-cylindrical sleeve having interior edge parts that define recesses, said recesses forming a break point such that said interior edge parts break off before the pair of inter-engaging body parts.

6. The device of claim 1, further comprising:

a releasing means connected to said carrier for only releasing said carrier from said shaft of said golf club by a tool or a key.

7. The device of claim 1, said pair of inter-engaging body parts resiliently engaging each other in snap-fit relationship.

8. The device of claim 6, each of said pair of inter-engaging body parts comprise at least two integral projections shaped so as to be inter-engageable respectivery with complementary integral projections on the other body part.

9. The device of claim 8, each of said projections defining an outwardly extending tooth that snap-fits around a corresponding tooth on the other body part.

10. The device of claim 9, said at least two integral projections comprising three sets of snap-fitting teeth orthogonally arranged.

11. The device of claim 9, each of the integral projections of one body part comprises a projecting rib, the other body part having a hole formed in a face thereof, the device further comprising:

an opening tool having a prong thereon, said projecting rib being engageable by said prong when said opening tool is inserted through said hole.

12. The device of claim 11, said prong acting on said projecting rib so as to cause a resilient deflection of said projecting rib sufficient to enable the tooth to be disengaged from the tooth of the complementary projection of the other body part.

13. The device of claim 1, said pair of inter-engaging body parts having rib- and-groove formations respectively in complementary matching relation so as to inter-engage upon closure of said carrier.

14. The device of claim 13, said rib-and-groove formations defining a labryinthine pathway therebetween.

* * * * *